US007484318B2

(12) United States Patent
Finkelstein

(10) Patent No.: US 7,484,318 B2
(45) Date of Patent: Feb. 3, 2009

(54) THERAPEUTIC SHOE SOLE DESIGN, METHOD FOR MANUFACTURING THE SAME, AND PRODUCTS CONSTRUCTED THEREFROM

(75) Inventor: Wayne Finkelstein, Bronx, NY (US)

(73) Assignee: Kenneth Cole Productions (LIC), Inc., Nassau (BS)

( * ) Notice: Subject to any disclaimer, the term of this patent is extended or adjusted under 35 U.S.C. 154(b) by 0 days.

(21) Appl. No.: 11/153,947

(22) Filed: Jun. 15, 2005

(65) Prior Publication Data

US 2006/0010717 A1 Jan. 19, 2006

Related U.S. Application Data

(60) Provisional application No. 60/579,928, filed on Jun. 15, 2004.

(51) Int. Cl.
*A43B 13/38* (2006.01)
*A43B 7/14* (2006.01)

(52) U.S. Cl. ..... 36/44; 36/153; 36/29

(58) Field of Classification Search ..... 36/43, 36/44, 153, 29

See application file for complete search history.

(56) References Cited

U.S. PATENT DOCUMENTS 1,559,532 A 10/1925 Smith
3,325,920 A 6/1967 Werner et al.
3,417,494 A * 12/1968 Claff ..... 36/44
3,469,576 A * 9/1969 Everts et al. ..... 36/154
3,552,044 A 1/1971 Wiele
4,225,202 A 9/1980 Chandler
4,255,202 A 3/1981 Swan, Jr.
4,658,515 A * 4/1987 Oatman ..... 36/44
5,150,490 A 9/1992 Busch et al.
5,313,717 A * 5/1994 Allen et al. ..... 36/28
5,392,534 A * 2/1995 Grim ..... 36/88
D460,852 S 7/2002 Daudier
7,037,571 B2 * 5/2006 Fish et al. ..... 36/71

* cited by examiner

*Primary Examiner*—Ted Kavanaugh
(74) *Attorney, Agent, or Firm*—Lackenbach Siegel, LLP

(57) ABSTRACT

A therapeutic device includes a supporting member that continuously and flexibly supports and bounds a plurality of small sized hard surfaced force members that support a user's foot during movement without clumping. The force members are slidable relative to each other and require no additional lubrication although dry or non-tacky liquid lubrication may be added. The support member is positioned on a support surface of a shoe sole and a shoe is constructed including the same. Alternative designs include structural members or positioning stitches relative to the supporting member minimizing undesirable movement of force members during use.

11 Claims, 6 Drawing Sheets

THERAPEUTIC SHOE SOLE DESIGN, METHOD FOR MANUFACTURING THE SAME, AND PRODUCTS CONSTRUCTED THEREFROM

RELATED APPLICATION AND PRIORITY CLAIM

This application claims priority to U.S. Provisional Application Ser. No. 60/579,928, filed Jun. 15, 2004, which is incorporated herein by reference in its entirety.

BACKGROUND OF THE INVENTION

1. Field of the Invention

The present invention relates to a shoe support or supportive insole. More specifically, the present invention relates to a flexible insole or shoe support construction containing a plurality of small sized items providing continuously flexible support.

2. Description of the Related Art

Many types of shoe supports exist for athletic and therapeutic purposes and several forms of rigidly supportive shoe insoles have been developed in pursuit of the same.

U.S. Pat. No. 3,325,920 by F. D. Werner et al., describes a process of filling external ankle sleeves or chambers on a ski boot with hardenable and expandable material (plastic foam is suggested) to provide permanent support during use. A user places their foot within the boot and the chambers are filled with the material which conforms to the shape of the ankle and lower leg and hardens, retaining the shape of the foot between uses. Werner also suggests that the chambers may be filled with particles (sand) surrounded with a sticky binder or sticky special coating such as wax, grease, or a tacky binder sufficient to cause the particles to stick together and provide the desired properties of retention of shape and firm support when the foot is removed. Werner warns that this alternative embodiment is inferior to the hardened material and further warns that this these goals cannot be achieved with liquid or air.

U.S. Pat. No. 3,552,044 by R. W. Wiele, describes a pad filled with soft elastomeric particles that do not shift but are elastically squeezed to adapt to a force applied to the pad providing a soft and comfortable elastomeric support.

U.S. Pat. No. 4,658,513 by Oatman, describes heat insulating footwear where spacer sheets are provided with a plurality of large area apertures that are loosely filled with particles of a soft elastomeric insulating plastic material. The particles are preferably formed from the same material as the spacer sheet and, in alternative embodiments, may hollow polystyrene or polyethylene beads. During use the particles act to minimize thermal transfer between a user's foot and keeping a user's foot cool.

OBJECTS AND SUMMARY OF THE INVENTION

The present invention relates to a foot or shoe support that continuously adapts to different user foot shapes during initial pressure application, and then provides a firm support to a user's foot during a complete stride. In this manner, medical and therapeutic foot conditions are easily accommodated while enabling necessary support during walking, jogging, sporting activities etc.

An object of the present invention is to provide a therapeutic shoe support that reaches the needs understood within the sport and therapeutic industries for a continuously adaptive shoe sole and foot support design.

According to an embodiment of the present invention there is provided a shoe design, comprising: a shoe member including at least one surface selected from at least one of a recessed supporting surface and a non-recess supporting surface, at least one supporting member on the at least one surface, the supporting member comprising at least one of a flexible skin member, an elastic skin member, and at least a partially inelastic skin member bounding at least a portion of a plurality of force support members and preventing their unintended separation from the sole member, the force support members being substantially small sized elements slidable relative to each other during an initial compression operation and inelastically packable during later compression operation, and the plurality of force support members and the skin member of the supporting member enabling a ready distribution of the small sized elements relative to each other and to a users foot during an initial use and between uses, whereby the supporting member provides a progressively resistive support adaptive to the shape of the user's foot during each the compression operation while minimizing an unintended agglomeration of particles between the uses.

According to another alternative embodiment of the present invention, there is provided a shoe design, wherein: the skin member is flexible and elastic, whereby the elastic skin member enables a rapid and progressive reshaping of the support member during respective the uses to adapt to the shape of the user's foot.

According to another alternative embodiment of the present invention, there is provided a shoe design, wherein: the sole member includes at least one recessed supporting surface, the respective skin member bounding the recessed supporting surface and forming the support member by retaining the plurality of force support members therebetween during the uses.

According to another alternative embodiment of the present invention, there is provided a shoe design, wherein: the sole member includes at least one recessed supporting surface, the support member on the at least one recessed support surface, the support member retainably positioned on the at least one recessed support surface by at least one of a friction fit, an adhesive, and a physical fixture, whereby unintended separation of the support member is prevented.

According to another alternative embodiment of the present invention, there is provided a shoe design, further comprising: at least two supporting surfaces on the shoe member, and a supporting member on each the supporting surface, whereby the user's foot is supported at two locations.

According to another alternative embodiment of the present invention, there is provided a shoe design, wherein: the force support members are selected from pluralities of at least rigid small sized elements and elastomeric small sized elements.

According to another alternative embodiment of the present invention, there is provided a shoe design, further comprising: at least one of dry lubricant and a fluid lubricant on the force support members, whereby the at least one lubricant facilitates the ready distribution during the use.

According to another alternative embodiment of the present invention, there is provided a shoe design, wherein: the force supporting members include at least an organic and an inorganic support member.

According to another alternative embodiment of the present invention, there is provided a shoe design, wherein: the force supporting members are organic and include a plurality of one of seeds, a plurality of non-seed elastomeric beads, and a plurality of a combination of the seeds and the non-seed elastomeric beads.

According to another alternative embodiment of the present invention, there is provided a shoe design, wherein: the supporting member further includes: at least one means for distribution support proximate the bounded force support members, the distribution support member including means for urging a distribution of the force supporting members between respective the uses to an initial status position, thereby limiting an unintended agglomeration of the force supporting members during respective the uses.

According to another alternative embodiment of the present invention, there is provided a shoe design, wherein: the means for distribution support includes at least one of a fixed in place elastic division member, a floating flexible division member, and a physical boundary, whereby the shoe design promotes a repetitive support mechanism during respective the uses.

According to another alternative embodiment of the present invention, there is provided a shoe kit, comprising: a first shoe support member including at least one support surface for supporting at least a first flexible support member, the first flexible support member further comprising: means for elastically containing a plurality of individually slidable force supporting members proximate the at least one support surface during at least a first force application use, the means for elastically containing including one of a means for a complete bounding of the plurality of individually slidable force supporting members and a means for partially bounding the plurality of individually slidable force supporting members relative to the at least one support surface, and the first repositionable support member being fixed relative to the first support surface during a use enabling a ready elastic distortion of the first flexible support member during the force-application use while also enabling a ready return to a ready state between force-application uses, thereby providing a readily adaptive supportive device.

According to another alternative embodiment of the present invention, there is provided a shoe kit, further comprising: one of a dry and a fluid lubricant on surfaces of ones of the plurality of individually slidable force supporting members, and the one lubricant easing a distribution and packing and redistribution of the plurality of force supporting members.

According to another alternative embodiment of the present invention, there is provided a shoe kit, wherein: the flexible support member further comprises at least one of a fixed in place elastic division member, a floating flexible division member, and a physical boundary, whereby the shoe kit and the one division member promotes a repetitive support mechanism during respective the uses.

According to another alternative embodiment of the present invention, there is provided a method for manufacturing a therapeutic shoe sole design comprising the steps of: preparing a sole member to receive at least one flexible supporting member on at least one selected support surface, preparing one of a plurality of substantially small sized bodies selected from a plurality of small sized rigid bodies and a plurality of small sized non-rigid bodies, the selected one of small sized bodies being surfaced in a manner enabling relative sliding between individual rigid bodies during a compressive use by a user's foot, preparing at least one of a flexible skin member for bounding the at least one supporting member and flexibly retaining the plurality of small sided bodies relative to the one selected support surface, filling a portion of the at least one flexible skin member bounding the supporting member with the plurality of small sized bodies and sealing the skin member thereby minimizing an unintended loss of ones of the plurality of small sized bodies during the compressive use, positioning and adhering the at least one supporting member on the sole member, and constructing a shoe body including the sole member and the supporting member.

According to another alternative embodiment of the present invention, there is provided a method for manufacturing a therapeutic shoe sole design wherein: the step of preparing one of a plurality of small sized bodies includes the selection of a plurality of small sized rigid bodies, and the step of positioning and adhering further includes a step of positioning the at least one supporting member at one of a toe location and a heel location of the sole member.

According to another alternative embodiment of the present invention, there is provided a method for manufacturing a therapeutic shoe sole design wherein: the step of filling a portion further includes the step of inserting a flexible member within the flexible support member, wherein the flexible member includes means for minimizing an unintended agglomeration of the ones of the plurality of small sized bodies between aid uses.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
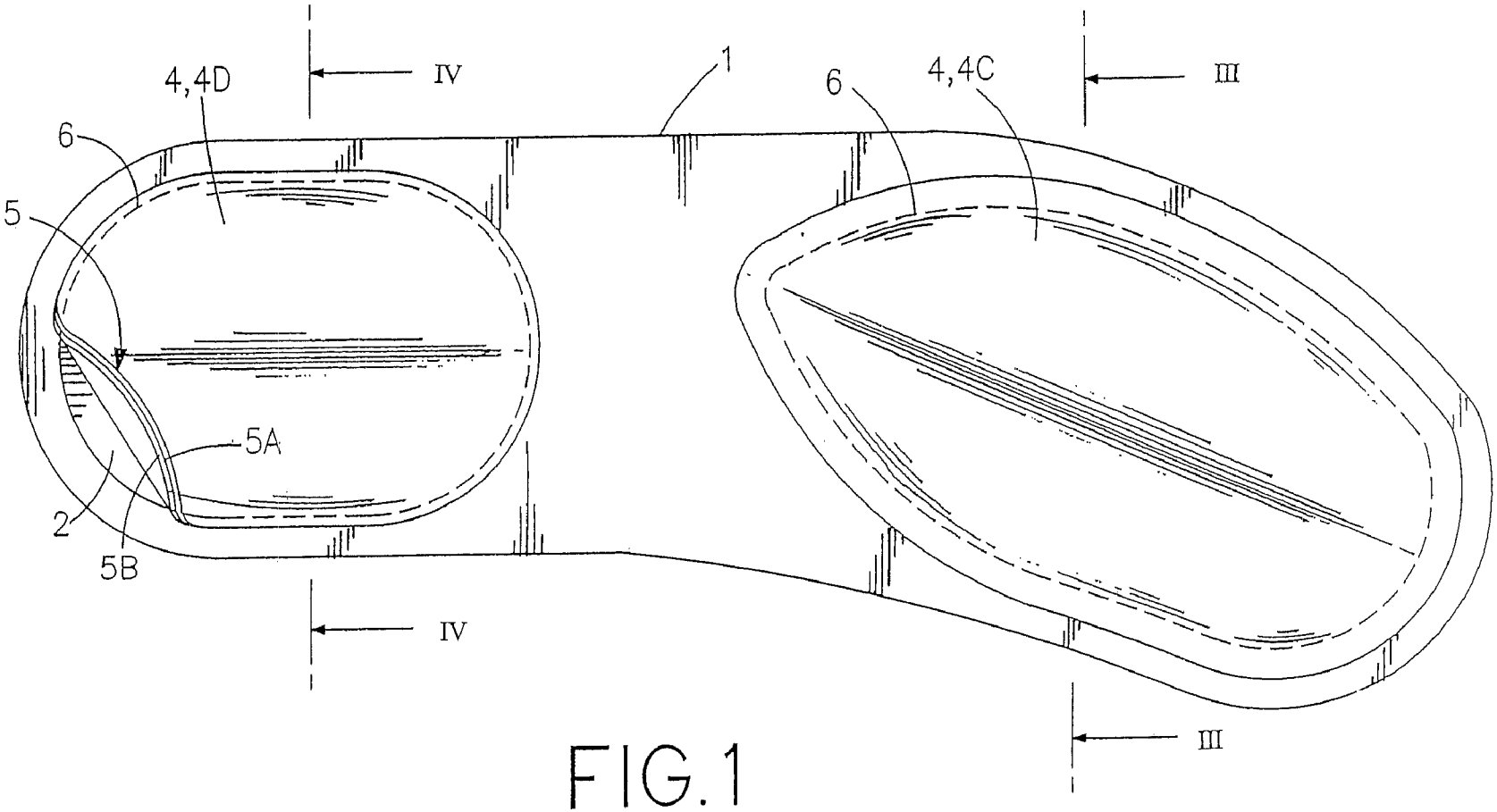
FIG. 1 is a plain view of one embodiment of the present invention.
Figure 2:
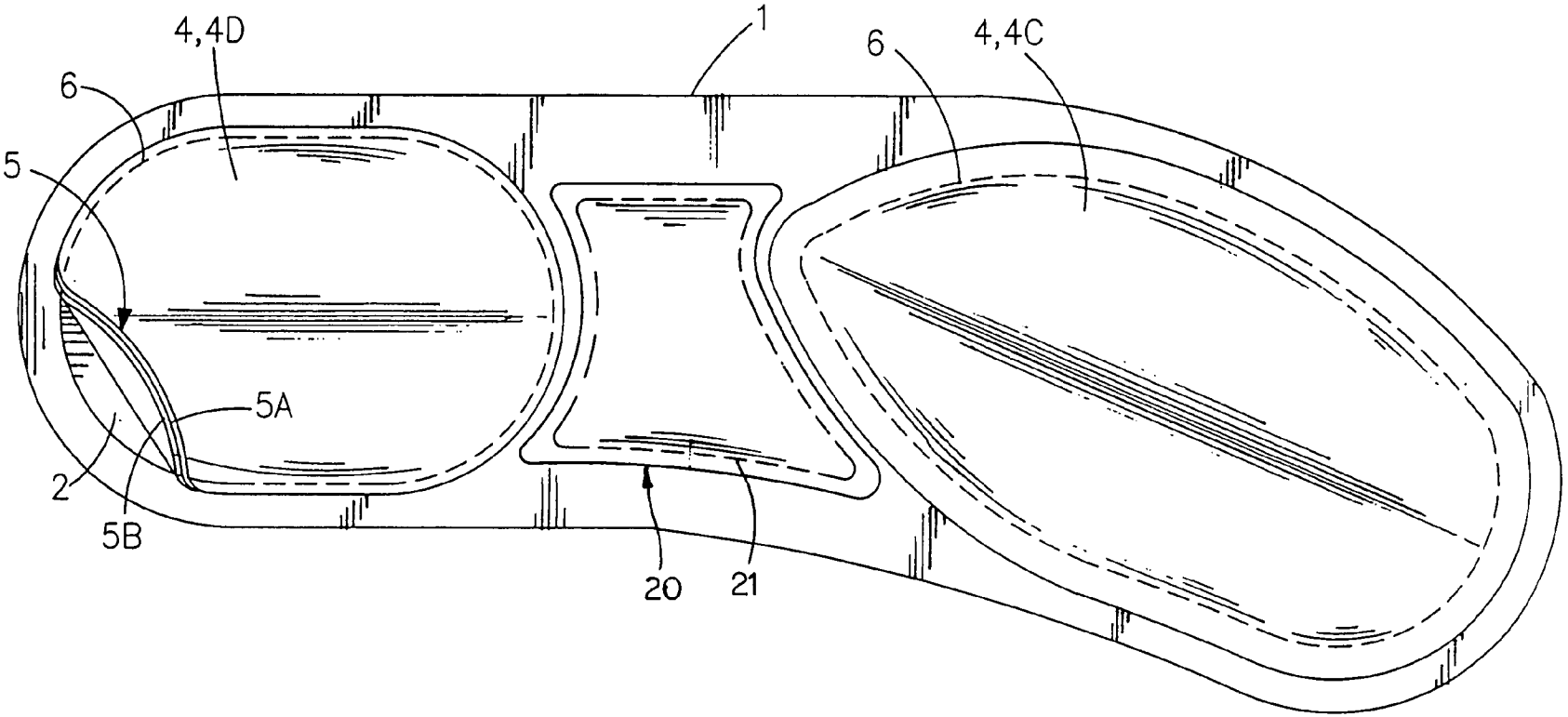
FIG. 2 is a plain view of another alternative embodiment of the present invention.
Figure 3:
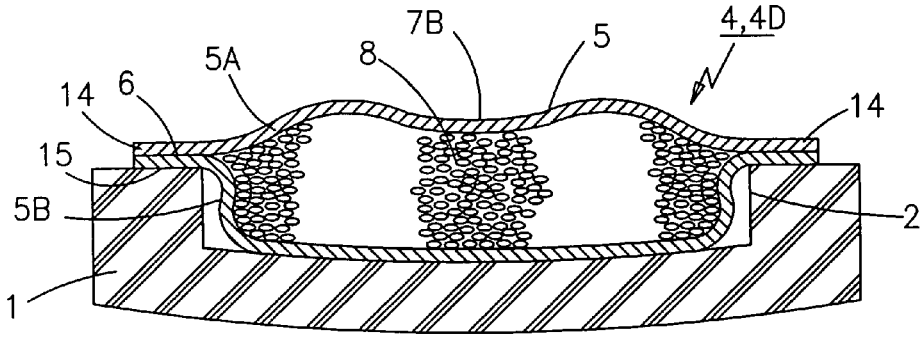
FIG. 3 is a sectional view along line I-I of FIG. 1.

Referring now to FIGS. 1 through 6, a sole support or sole member 1 includes front or rear support recesses 2 for receiving one or more supporting members 4 (4C, 4D as shown).

Sole member 1 is typically made from a material common to the shoe industry, and is often an expanded foam or shaped rubber or plastic material. Supporting recesses 2 may be formed in any conventional shape and may be replaced, in some designs, with a non-recess support surface. Alternative embodiments are envisioned wherein a support recess extends continually from the front portion to the rear portion of the sole member or assumes an alternatively adaptive shape and receives a correspondingly shaped support member (not shown)

As shown, the rear support member 4D includes top and bottom flexible or elastic skin members 5 (5A, 5B) joined by a continuous edge seam 6 about an outer periphery forming a glue flange region 14 extending outwardly. A glue layer 15 joins glue flange region 14 to sole member 1, as shown. As shown, bottom member 5B is larger than top member 5A and minimizes wrinkles and provides a good fit within recess 2, as will be described. In other embodiments, recesses 2 may be adaptively shaped with rounded corners or in two opposing shapes defining two side-by-side chambers to generally contain a plurality of small force or support members (as will be described).

In alternative embodiments, skin members 5, (5A, 5B) may be selected from different materials, porous or non-porous, elastic or non-elastic and flexible or non-flexible depending upon adaptations of the present design, without departing from the scope and spirit of the present invention.

In one selected embodiment, bottom member 5B is selected from a substantially inelastic tough material to minimize abrasion and damage and increase support of top member 5A. In this selected embodiment, top member 5A is selected from a flexible elastic material enabling a ready displacement of supporting member vertically and torsionally within bounded recess 2 during use, but minimizing displacement laterally thereby minimizing damage to supporting member 4.

A plurality of force or support particles or members 8 is retained by skin member 5 within or on recesses 2 as shown. Particles 8 should be understood as small sized ⅛ inch or so generally firm or solid inelastic members and may be spherical, generally ovoid, ellipsoidal, pear-shaped or generally any relatively smoothly surfaced geometry bounding a volume.

In one preferred embodiment, the surface of each particle or member 8 preferably enables each particle to loosely slide (freely redistribute) relative to each other during decompression and yet tightly pack into a supporting matrix during compression supporting a user's foot (contrary to the generally continuous elastic nature of sole member 1, in for example sandals, or a molded rubber or plastic sole member found in higher heeled shoes).

In one preferred embodiment of the present invention, particles 8 are flax seeds and are beneficially shaped in an elongated-rounded shape (a flattened tear-drop ellipsoid) that enables the seeds to slide readily relative to each other under initial displacement force (enabling ready adaption to diverse foot structure), and upon further displacement packing together and resisting additional dispersion (enabling firm foot support during a complete leg-stride cycle).

Those of skill in the art of particle science, particle packing, rheology, and flow dynamics will understand that by selecting various particle shapes, surface textures, particle materials (rigid, flexible, elastic, etc.), or a selection of the same with or without lubricant, that the responsiveness and support of the supporting member may be tailored to a particular need (sport, therapy, walking), and that the continually adaptive resistance may be continually progressive (like an elastomer) or may act in a pseudo-plastic manner, or operate as a dilatent system (initial fluid flow/elastomeric state followed by a rigid state based on sheer forces (compression etc.) applied.

In a manufacturing method constructing the present apparatus, the elemental constructive steps are noted above. Where an embodiment employs flax seeds as particles 8, it is preferable, but not mandatory, to heat the seeds sufficiently (or take other measures) to prevent germination during use.

A general central region 7B on top member 5A of flexible member 5 aids in the useful separation of the force particles into two partial halves to minimize non-essential central pooling. Region 7B is not mandatory to the spirit and scope of the invention, but is useful in maintaining a common neutral position for particles 8 between user strides and preventing an unbalanced distribution of particles 8 (leading to temporary user discomfort while particles 8 are redistributed).

Figure 4:
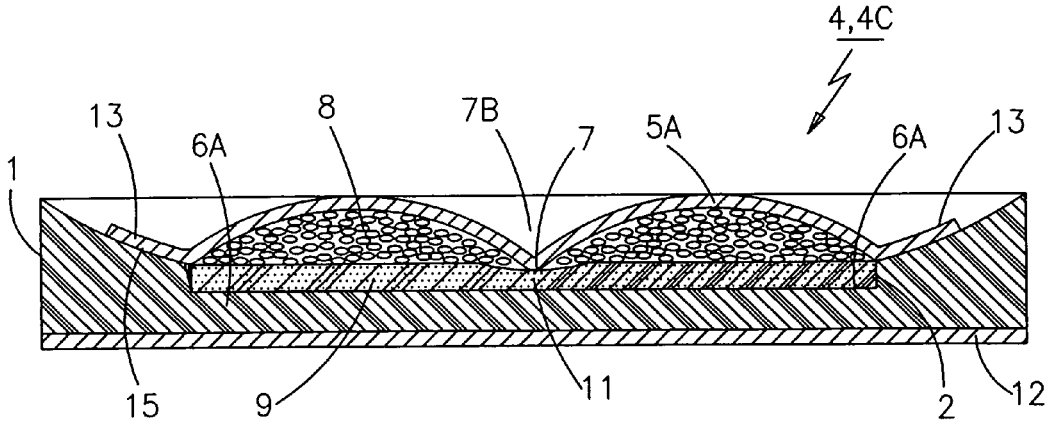
FIG. 4 is a sectional view along line II-II of FIG. 1.

While front support member 4C may be constructed as described above, one alternative embodiment for front support member 4C is noted in FIG. 4, wherein skin member 5A is constructed from a similar material as noted above and includes outer glue flange 13. Glue layer 15 adheres glue flange 13 to sole member 1. In this section, a firm support member 12 is under the ball of the user's foot and provides additional support.

Front recess 2 includes a small central seam support tape member 11 extending along a bottom of front recess 2, and an elastomeric foam pad member 9 is secured above, generally using adhesive. Foam pad member 9 may be selected from any type of foam elastomeric material commonly used within the shoe industry. Foam pad member 9 serves to cushion and support a plurality of force members 8, as shown retained below flexible member (skin) 5A. A seam 7 extends between top skin member 5A and tape member 11 securing foam pad member and forming general central region 7B. As can be seen, seam 7 generally divides front support member 4C into two chambers, each chamber elastically securing a plurality of force members 8. Since top member 5A is elastic, a users foot and the force members can shift and compact during use under shear or compressive forces while still providing support to a user's foot after the particles pack together to resist the force applied. The present design enables each chamber to move relative to the other and to sole member 1, thereby accommodating different support needs and food positions (as well as different user foot shapes and foot uses (toe-only-walking vs. heel-toe-walking).

Figure 5:
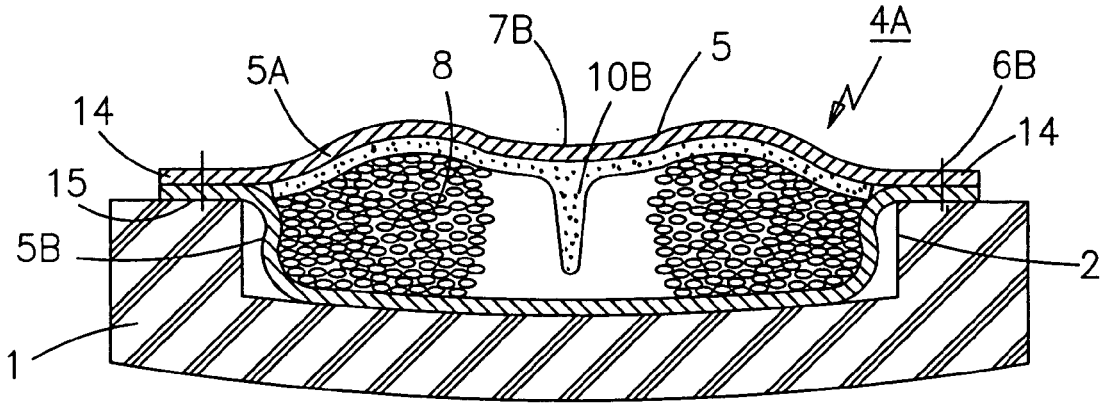
FIG. 5 is an alternative sectional view along line I-I of FIG. 1.

Alternative designs are envisioned encompassing the general principals of the present invention. In FIG. 5, a recess 2 supports an alternative supporting member 4A including an additional top foam guide member 10B below top member 5A, as shown. Foam guide member 10B includes a downwardly extending compressible finger portion (as shown) that serves as an aid in maintaining a beneficial neutral distribution of particles 8 between user strides, and preventing particles 8 from agglomerating in a central mass, while allowing redistribution. During use, a user's foot would similarly exert initial downward or sideways force (sheer and compression) enabling an elastic movement of top member 5A and an initial sliding/shifting of particles 8 to accommodate a user's foot shape or stride pattern (pronation) upon initial pressure. As additional foot force is exerted, particles 8 additionally redistributed and further pack together (providing progressive resistance) and provide a firm support that has already adapted to a user's foot shape. In this way, the present invention envisions that a wide range of adaptive supporting members may be designed for all manner of footwear that fully avoid the previously known art.

Figure 6:
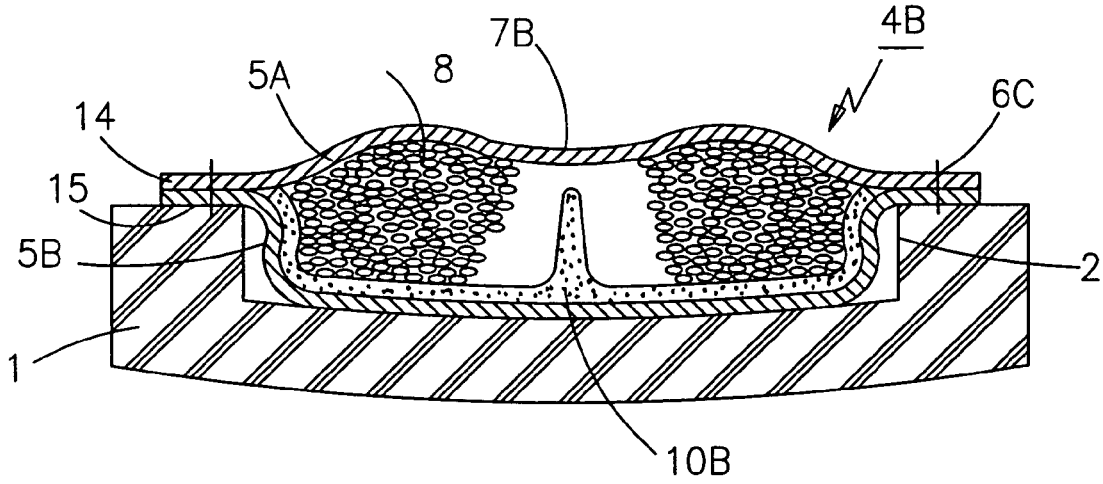
FIG. 6 is an yet another alternative sectional view along line I-I of FIG. 1.

Another alternative design is envisioned as depicted in FIG. 6 wherein recess 2 supports supporting member 4 that includes a foam guide 10B along bottom member 5B. Here a similar solution is provided to that discussed above but the projecting compressible finger portion (as shown) extends upwardly toward top member 5A. As above, upwardly projecting finger portion serves to generally shape supporting member into two chambers. This design allows a ready distribution of particles or members 8 during an initial force and the return to a neutral position between strides. Thus, while foam inserts 10B discussed above may be used to a benefit, they are not required.

It should be understood and appreciated, that one benefit of the present invention is that it enables the ready repositioning of members 8 after every stride into a neutral position ready for the next compression/shear operative phase. This repositioning is induced via the elastic forces provided by skin members. It should be additionally noted, that particles 8 substantially fill the bounded cavities in support members allowing a ready shifting but supported by the elastic skin members. This ready repositioning prevents uncomfortable lumpy distribution of members 8, or the loss of members 8 into the corner portions of recesses 2 and the resultant loss of support. In one embodiment, bottom member 5B is an elastomeric member that enables the distribution of members 8 into corners of recess 2 during a downward force, but return to a neutral position between strides. In this manner, the present invention returns to a neutral support position between each stride and increases user comfort and support.

Figure 7:
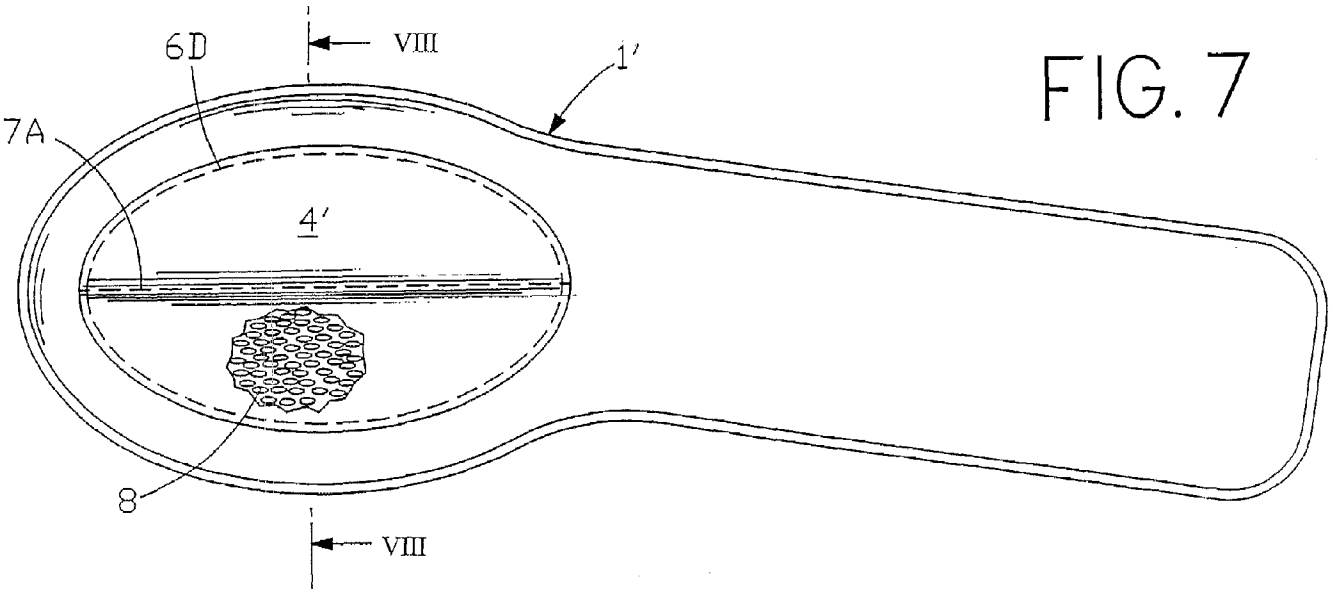
FIG. 7 is a partially cut-away view of another alternative embodiment of the present invention.
Figure 8:
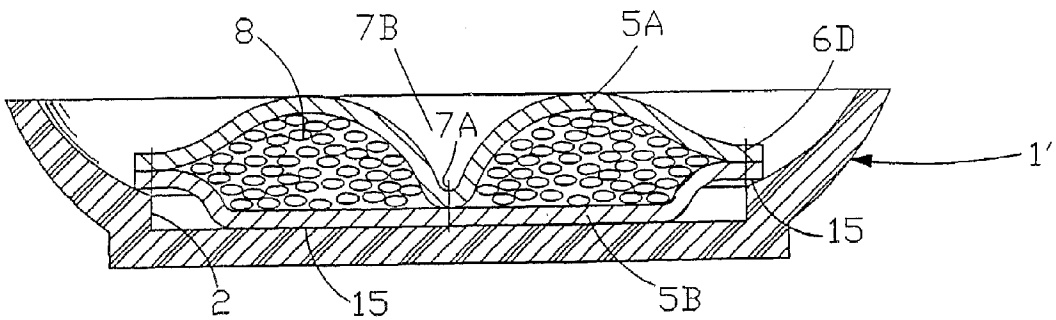
FIG. 8 is a cross-sectional view along line III-III of FIG. 7.

As alternatively disclosed in FIGS. 7 and 8, sole member 1' is constructed from a firm but flexible plastic material and integrally defines a recess 2' as shown. In this embodiment, supporting member 4' is positioned and secured within recess 2' with an adhesive. A central seam 7A is formed with stitching prior to assembly, and only minor glue flanges 14 are used since additional glue 15 is provided under the central portion of bottom member 5B. Similar to the above embodiments, this design is suited to a wide variety of designs, but is particularly useful in women's heeled shoes where a rigid heal member forms a pump or other high-heel structure and the benefits of the invention are concentrated under the ball of the foot where a majority of force is applied.

It is additionally envisioned, that particles or members 8 may be selected from an elastomeric, pseudo-plastic, etc. material to provide an additional level of elastic support. It is similarly envisioned, that skin members may be filled with a combination of members 8 and an other element, for example a thixotropic fluid, lubricant, deflocculant, or may include some elastomeric and some non-elastomeric particles.

It is additionally envisioned, that a user may select a multimodal size distribution for particles 8, to enable a readily adapted distribution and strength in packing. It is also envisioned, that the present invention uses of supporting members 4 may be adopted to any type of footwear including boots, sporting footwear etc. In another embodiment, an additional non-tacky lubricant (dry (graphite etc.) or liquid/fluid) is included with particles 8 enabling an initial sliding between particles while allowing the particles to pack together (in an organized or unorganized structure) under increasing compression.

It is also envisioned, that another embodiment of the present invention may include a shoe having a shock absorbing sole, a polyfoam foot bed with supporting members, a hardboard support, and a soft deer skin cover between the supporting members and a user's foot.

Figure 10:
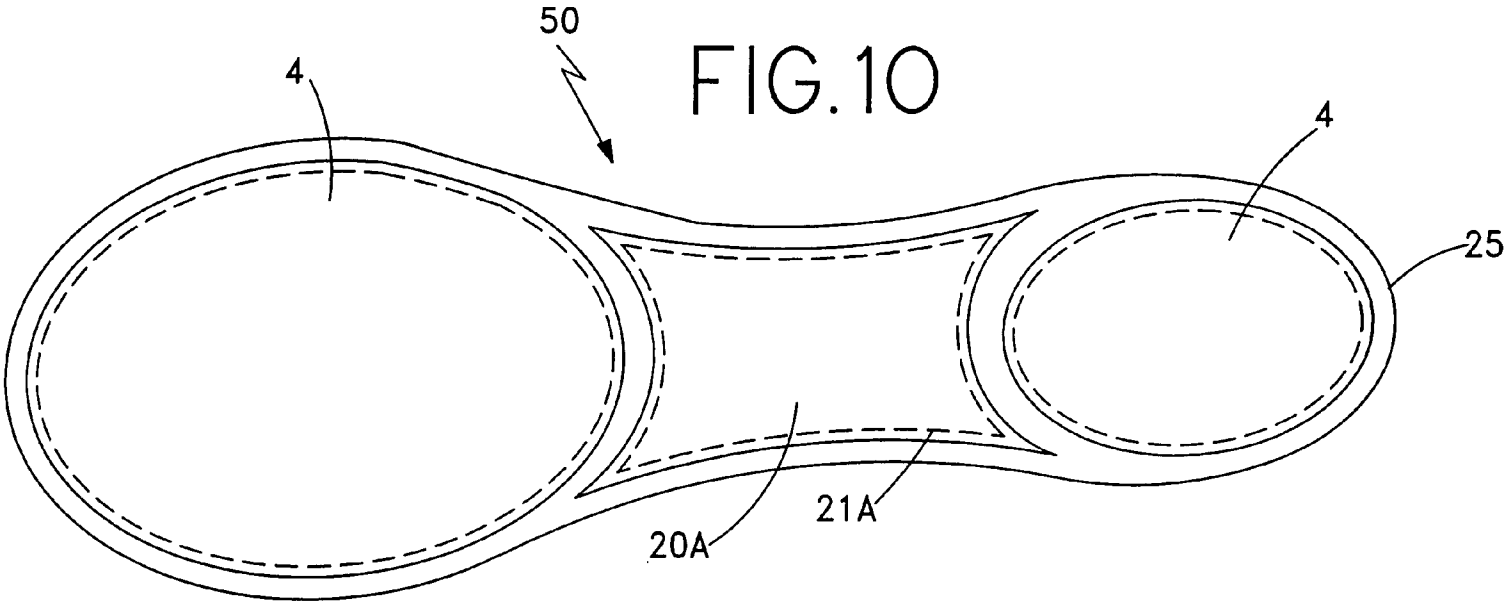
FIG. 10 is a top plain view of the alternative embodiment of FIG. 10.
Figure 9:
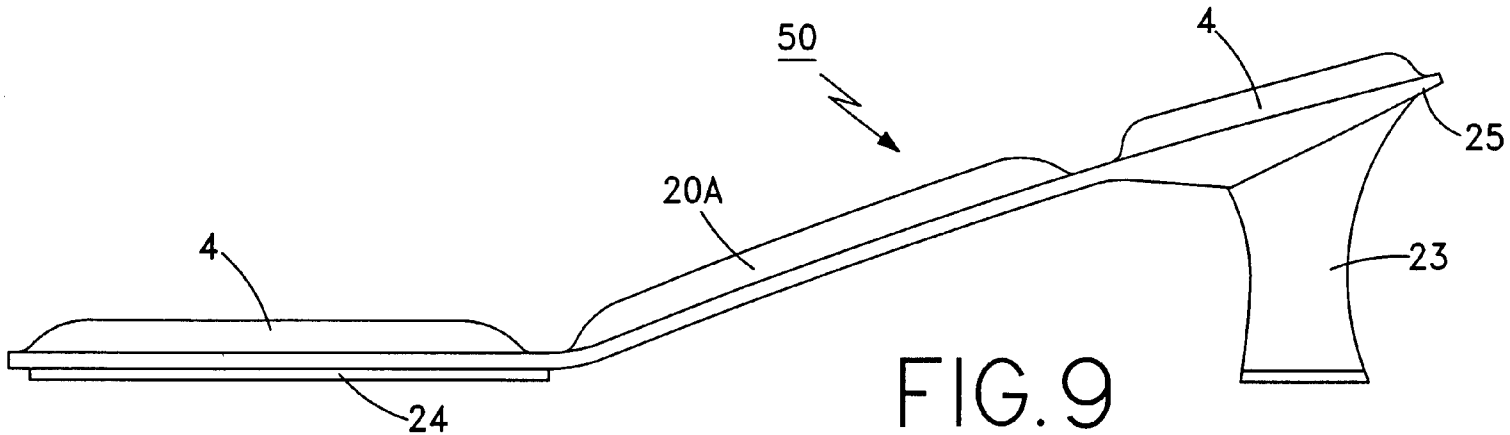
FIG. 9 is a side view of yet another alternative embodiment of the present invention.

Referring now to FIGS. 9 and 10, an alternative embodiment of the present invention is provided at 50 wherein a centrally located third support member 20A having an outer seam 211A is provided on a shoe support 25 having a front tread 24 and a rear heal 23.

In this alternative embodiment, those of skill in the art will recognize, that front and rear support members 4,4, may have a different fill percentage than support member 20A, enabling support member 20A to provide arch support. In alternative embodiments, the front and rear support cushions may be of conventional construction, and central support member 20A may operate according to the disclosure above. In sum, it is proposed, that support devices may be adaptively shaped and configured to enable a very broad adaption and integration into to the wide variety of conventional shoe shapes.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the claims.

What is claimed is:

1. A shoe design, comprising:

a shoe member including at least one surface selected from at least one of a recessed supporting surface and a non-recess supporting surface;

at least one supporting member on said at least one surface;

said supporting member comprising at least one of a flexible skin member, an elastic skin member, and at least a partially inelastic skin member, said at least one bounding at least a portion of a plurality of force support members and preventing their unintended separation from said sole member;

said force support members being substantially small sized non-spherical rigid organic seed elements slidable relative to each other during an initial compression operation and being inelastically packable during later compression operation; and said plurality of force support members and said skin member of said supporting member enabling a ready distribution of said small sized rigid elements relative to each other and to a user's foot during an initial use and between each said compressive operation uses, whereby said supporting member provides an inelastically packable non-compressible resistive support adaptive to the shape of said user's foot during each said compression operation.

2. A shoe design, according to claim 1, wherein: said skin member is flexible and elastic, and whereby said elastic skin member enables a rapid and progressive elastic reshaping of said support members during respective said uses to adapt to said shape of said user's foot.

3. A shoe design, according to claim 1, wherein:

said shoe member includes at least one recessed supporting surface;

said respective skin member bounding said recessed supporting surface and forming said support member by retaining said plurality of force support members therebetween during said uses.

4. A shoe design, according to claim 2, wherein:

said shoe member includes at least one recessed supporting surface;

said support member on said at least one recessed support surface;

said support member retainably positioned on said at least one recessed support surface by at least one of a friction fit, an adhesive, and a physical fixture, whereby unintended separation of said support member is prevented.

5. A shoe design, according to claim 1, further comprising:
at least two supporting surfaces on said shoe member; and
a supporting member on each said supporting surface, whereby said user's foot is supported at two locations.

6. A shoe design, according to claim 1, wherein:
said force support members comprise have a flattened dear-drop ellipsoidal shape.

7. A shoe design, according to claim 6, further comprising:
at least one of dry lubricant and a fluid lubricant on said force support members, whereby said at least one lubricant facilitates said ready distribution during said use.

8. A shoe design, according to claim 1, wherein:
said force supporting members further comprise a combination of said seeds and said non-seed elastomeric beads.

9. A shoe kit, comprising:
a first shoe support member including at least one support surface for supporting at least a first flexible support member;
said first flexible support member further comprising:
means for elastically containing a plurality of individually slidable non-spherical organic force supporting members proximate said at least one support surface during at least a first force application use;
said means for elastically containing including one of a means for a complete bounding of said plurality of individually slidable force supporting members and a means for partially bounding said plurality of individually slidable force supporting members relative to said at least one support surface;
said first support member being fixed relative to said first support surface during a force application use enabling a ready elastic distortion of said first flexible support member during an initial force-application use while also enabling a ready elastic returning force to a non-elastically distorted ready state between each respective force-application use; and
a dry lubricant on surfaces of ones of said plurality of individually slidable force supporting members which are inelastically packable during said force application use.

10. A shoe kit, according to claim 9, further comprising:
said lubricant easing a distribution and packing and redistribution of said plurality of force supporting members.

11. A shoe kit, according to claim 9, wherein:
said flexible support member further comprises at least one of a fixed in place elastic division member inside said flexible support member, a non-fixed in place floating flexible division member in said flexible support member, and a physical boundary subdividing said flexible support member into at least two bounded volumes, whereby said shoe kit and said one division member promotes a repetitive support mechanism during respective said uses.

* * * * *